US008090275B2

(12) United States Patent
Takeuchi

(10) Patent No.: US 8,090,275 B2
(45) Date of Patent: Jan. 3, 2012

(54) IMAGE FORMING APPARATUS

(75) Inventor: Kenji Takeuchi, Aichi (JP)

(73) Assignee: Brother Kogyo Kabushiki Kaisha, Aichi (JP)

( * ) Notice: Subject to any disclaimer, the term of this patent is extended or adjusted under 35 U.S.C. 154(b) by 105 days.

(21) Appl. No.: 12/731,832

(22) Filed: Mar. 25, 2010

(65) Prior Publication Data

US 2011/0064426 A1 Mar. 17, 2011

(30) Foreign Application Priority Data

Sep. 15, 2009 (JP) ..... 2009-213202

(51) Int. Cl.
*G03G 15/00* (2006.01)

(52) U.S. Cl. ..... 399/16; 399/22

(58) Field of Classification Search ..... 399/9, 16, 399/18, 21–23, 66–68, 301, 303, 397, 400; 271/228, 248–252
See application file for complete search history.

(56) References Cited

U.S. PATENT DOCUMENTS 6,356,735 B1 * 3/2002 Hozumi ..... 399/395
2003/0165348 A1 9/2003 Amita et al.

FOREIGN PATENT DOCUMENTS

| | | |
|---|---|---|
| JP | 8-262823 A | 10/1996 |
| JP | 2002-006570 | 1/2002 |
| JP | 2003-255750 A | 9/2003 |
| JP | 2007-199524 | 8/2007 |

OTHER PUBLICATIONS

Notification of Reasons for Rejection dated Aug. 30, 2011 received from the Japanese Patent Office from related Japanese Application No. 2009-213202, together with an English-language translation.

* cited by examiner

*Primary Examiner* — Hoan Tran
(74) *Attorney, Agent, or Firm* — Scully, Scott, Murphy & Presser, PC

(57) ABSTRACT

An image forming apparatus is provided. The image forming apparatus includes a fixing unit to thermally fix an image transferred onto a sheet thereto, an endless belt to carry the sheet in a feeding path toward the fixing unit, a pattern forming unit to form an image pattern on the belt, a sensor to detect presence of the sheet being carried by the belt, and a judging unit to judge as to whether the sheet is in one-sided alignment, in which the sheet is aligned to one of the widthwise sides in the feeding path based on a result detected by the sensor.

10 Claims, 9 Drawing Sheets

| | RESULT DETECTED BY RIGHT-SIDE SENSOR | RESULT DETECTED BY LEFT-SIDE SENSOR | JUDGEMENT |
|---|---|---|---|
| P1 | — | — | CENTER |
| P2 | + | — | ONE-SIDE |
| P3 | — | + | ONE-SIDE |
| $P_{MAX}$ | + | + | CENTER |

| | RESULT DETECTED BY MISALIGNMENT DETECTABLE SENSOR | SHEET SIZE | JUDGEMENT |
|---|---|---|---|
| P1 | — | SMALLER WIDTH | CENTER |
| P2 | + | SMALLER WIDTH | ONE-SIDE |
| P3 | — | SMALLER WIDTH | CENTER |
| $P_{MAX}$ | + | MAXIMUM-ALLOWABLE WIDTH | CENTER |

IMAGE FORMING APPARATUS

CROSS REFERENCE TO RELATED APPLICATION

This application claims priority from Japanese Patent Application No. 2009-213202, filed on Sep. 15, 2009, the entire subject matter of which is incorporated herein by reference.

BACKGROUND

1. Technical Field

An aspect of the present invention relates to an image forming apparatus having a fixing unit to thermally fix a transferred image onto a recording sheet.

2. Related Art

An image forming apparatus to form an image electrophotographically is often provided with a fixing device, which thermally fixes a toner image transferred to a recording sheet thereon. For example, a fixing device including a heat roller to heat the recording sheet with the toner image and a pressure roller to press the recording sheet against the heat roller are known. As the recording sheet is fed in between the heat roller and the pressure roller, the toner image is thermally fixed onto the recording sheet.

When smaller-sized recording sheets, smaller than axial lengths of the rollers, such as postcards, are fed in the fixing device, a part of the heat roller which does not contact the recording sheets retains heat, and temperature in the part may increase to be higher than temperature in the remaining part which contacts the recording sheet. If the temperature is excessively increased, bearings to hold the heat roller may melt and deformed. In order to avoid such deformation, therefore, the fixing device may be equipped with a heat sensor, which senses the temperature of the heat roller so that the fixing operation in the fixing device can be ceased when the sensor detects excessively increased temperature in the heat roller.

SUMMARY

The fixing device may be equipped with a plurality of sensors to detect excessively increased temperature in the heat roller; however, in order to provide the image forming apparatus including a fixing device in lower manufacturing cost, it is preferable that the quantity of the sensors is reduced to, for example, one to be provided solely on one of the two sides of the heat roller. With the one-sided sensor, however, temperature in the other side of the heat roller, on which no sensor is provided, is not detected specifically when the smaller-sized recording sheets are fed in off-centered one-sided alignment. In consequence, the bearing on the other side may melt. In order to avoid the one-sided alignment of the recording sheets, a sensor to detect the alignment of the recording sheets with respect to a feeding path may be provided, although the additional sensor increases the manufacturing cost.

In view of the above difficulties, the present invention is advantageous in that an image forming apparatus, which is capable of detecting the one-sided alignment of the recording sheets whilst the manufacturing cost is maintained lower, is provided.

According to an aspect of the present invention, an image forming apparatus is provided. The image forming apparatus includes a fixing unit to thermally fix an image transferred onto a sheet thereto, an endless belt to carry the sheet in a feeding path toward the fixing unit, a pattern forming unit to form an image pattern on the belt, a sensor to detect presence of the sheet being carried by the belt, and a judging unit to judge as to whether the sheet is in one-sided alignment, in which the sheet is aligned to one of the widthwise sides in the feeding path based on a result detected by the sensor.

BRIEF DESCRIPTION OF THE ACCOMPANYING DRAWINGS

FIG. 1. is a cross-sectional side view of a color printer according to an embodiment of the present invention.

DETAILED DESCRIPTION

Hereinafter, embodiments according to the present invention will be described with reference to the accompanying drawings.

First Embodiment

A color printer 1 being an image forming apparatus will be described. In the following description, overall configuration and behaviors of the color printer 1 will be described. Further, a controlling flow to judge one-sided alignment of recording sheets P, behaviors of the color printer 1 based on the judgment, and configuration related to the behaviors will be described.

Figure 1:
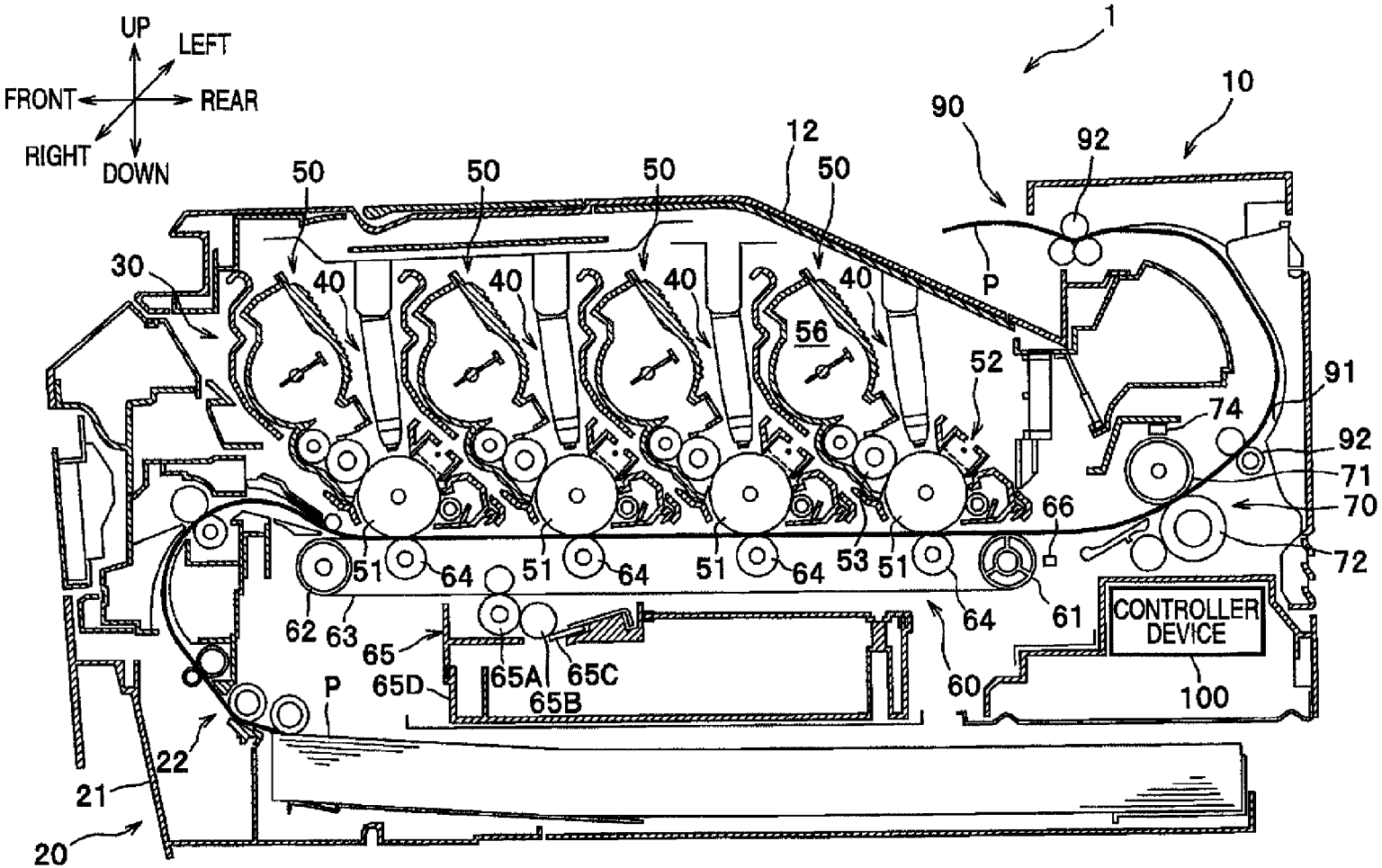

In the embodiments described below, directions concerning the color printer 1 will be referred to in accordance with the orientation of the color printer 1 shown in FIG. 1. That is, a left-hand side in FIG. 1 is referred to as front, and a right-hand side is referred to as rear. Further, a right-left direction of the printer 1 refers to a direction perpendicular to the cross-section of the printer 1 in FIG. 1, and is also referred to as a widthwise direction. A closer side in FIG. 1 is referred to as right, and a further side in FIG. 1 is referred to as left. An up-down direction shown in FIG. 1 corresponds to the up-down (i.e., vertical) direction of the color printer 1.

Overall Configuration of the Color Printer

The color printer 1 according to the present embodiment includes a feeder unit 20 to feed recording sheets Pin a feeding path, an image forming unit 30 to form images on the recording sheets P, and a discharge unit 90 to discharge the recording sheets P with the printed images, and a controller device 100 within a chassis 10.

In the color printer 1, the recording sheets P are carried in the feeding path with reference to a widthwise center thereof. That is, the recording sheets P are fed in the chassis 10 with the widthwise center thereof being aligned to a center of the feeding path regardless of sizes of the recording sheets P to have images formed thereon and to be discharged out of the chassis 10. The configuration to feed the recording sheets P in the centered alignment is known; therefore, explanation of that is omitted.

The feeder unit 20 is provided in a lower portion in the chassis 10 and includes a sheet tray 21 to store the recording sheets P therein and a feeding mechanism 22 to pick up the recording sheets P one by one from the sheet tray 21 and feed to the image forming unit 30.

The image forming unit 30 includes four LED units 40, four processing units 50, a transfer unit 60, and a fixing unit 70.

Each of the LED units 40 is arranged in a position above one of four photosensitive drums 51 and has a plurality of light emitters (not shown), i.e., LEDs, aligned in an axial direction of the photosensitive drum 51 (i.e., the widthwise direction of the color printer 1) at a lower end portion thereof. The LED unit 40 emits light from the LEDs selectively according to inputted image data to an electrically charged surface of the photosensitive drum 51.

The processing units 50 are arranged in line in the front-rear direction between the discharge tray 12 and the feeder unit 20. Each of the processing units 50 includes the photosensitive drum 51, a charger 52, a developer roller 53, and a toner container 56.

The transfer unit 60 is arranged in a position between the feeder unit 20 and the processing units 50. The transfer unit 60 includes a driving roller 61, a driven roller 62, a conveyer belt 63 being an endless belt extended to encircle the driving roller 61 and the driven roller 62, four transfer rollers 64, and a cleaning unit 65. The conveyer belt 63 is in contact with the surfaces of the photosensitive drums 51 at an upper external surface thereof and with surfaces of the transfer rollers 64 at an upper internal surface thereof so that the transfer rollers 64 and the photosensitive drums 51 nip the upper part of the conveyer belt 63 therebetween.

The cleaning unit 65 is arranged in a lower portion below the conveyer belt 63 and includes a cleaning roller 65A, a remover roller 65B, a blade 65C, and a toner reservoir 65D. Toner adhered to the surface of the conveyer belt 65 is removed therefrom by the cleaning roller 65A and transferred to a surface of the remover roller 65B. Further, the toner on the surface of the remover roller 65B is scraped off by the blade 65C to be collected and stored in the toner reservoir 65D.

The fixing unit 70 is arranged in a position closer to the rear of the chassis 10 with respect to the processing units 50 and the transfer unit 60. The fixing unit 70 includes a heat roller 71 and a pressure roller to press against the heat roller 71.

In the image forming unit 30, the photosensitive surface of the photosensitive drum 51 is uniformly charged by the charger 52 and thereafter exposed to the light emitted from the LED unit 40 so that a latent image is formed on the surface of the photosensitive drum 51 based on the image data. The latent image is provided with the toner by the developer roller 53, which carries the toner in a thin layer on a surface thereof. Thus, a toner image is developed on the surface of the photosensitive drum 51.

When the recording sheet P is carried on the conveyer belt 63 and passes in between the photosensitive drums 51 and the transfer rollers 64, the toner images formed on the photosensitive drums 51 are transferred in layers onto the recording sheet P. The recording sheet P is further carried in between the heat roller 71 and the pressure roller 72 so that the toner images formed on the recording sheet P are thermally fixed thereon.

The discharge unit 90 is arranged in a rear portion in the chassis 10 and includes a discharge path 91, which is in connection with an outlet of the fixing unit 70 and extends in a curve to upward-front to an outlet (not shown) of the chassis 10, and a plurality of conveyer rollers 92, which carry the recording sheet P along the discharge path 91. The recording sheet P carried by the conveyer rollers 92 is discharged out of the chassis 10 onto the discharge tray 12, which is formed in a top portion of the chassis 10.

Controller Device

Next, a controlling flow to judge one-sided alignment of recording sheets P, behaviors of the color printer 1 based on the judgment, and configuration related to the behaviors will be described.

The controller device 100 is arranged in the chassis 10 and includes a judging unit 110 and a controller unit 120. The controller device 100 includes a storage unit 190 and a CPU (not shown), and an I/O circuit (not shown). Signals from various kinds of sensors are inputted in the controller device 100, and the CPU executes programs stored in the storage unit 190 to achieve functions of the color printer 1.

The judging unit 110 judges one-sided alignment of the recording sheet P in the feeding path based on sensed result obtained from a misalignment detectable sensor 66, which will be described later in detail.

The one-sided alignment refers to a position of the recording sheet P in the feeding path. When the recording sheet P is in the one-sided alignment, the recording sheet P which has to be fed in centered alignment in the widthwise center of the feeding path is carried off-centered to either side in feeding path. The one-sided alignment may occur, for example, when a user sets the recording sheets P in the sheet tray 21 in an off-centered position closer to either side.

The controller unit 120 controls behaviors of the color printer 1 according to the programs, data stored in the storage unit 190, and outputs from the sensors and the judging unit 110. Behaviors to be controlled according to judgment made by the judging unit 110 will be described later in detail.

The color printer 1 in the present embodiment further includes an informer unit 80, which provides the user with various kinds of messages (e.g., warning). The informer unit 80 includes, for example, a display to present text and images through a screen, a speaker to generate a message sound, and lamps to notify the user of events by illumination and blinking. The informer unit 80 may include two or more of the display, the speaker, and the lamps.

LED Units and Processing Units

Figure 3:
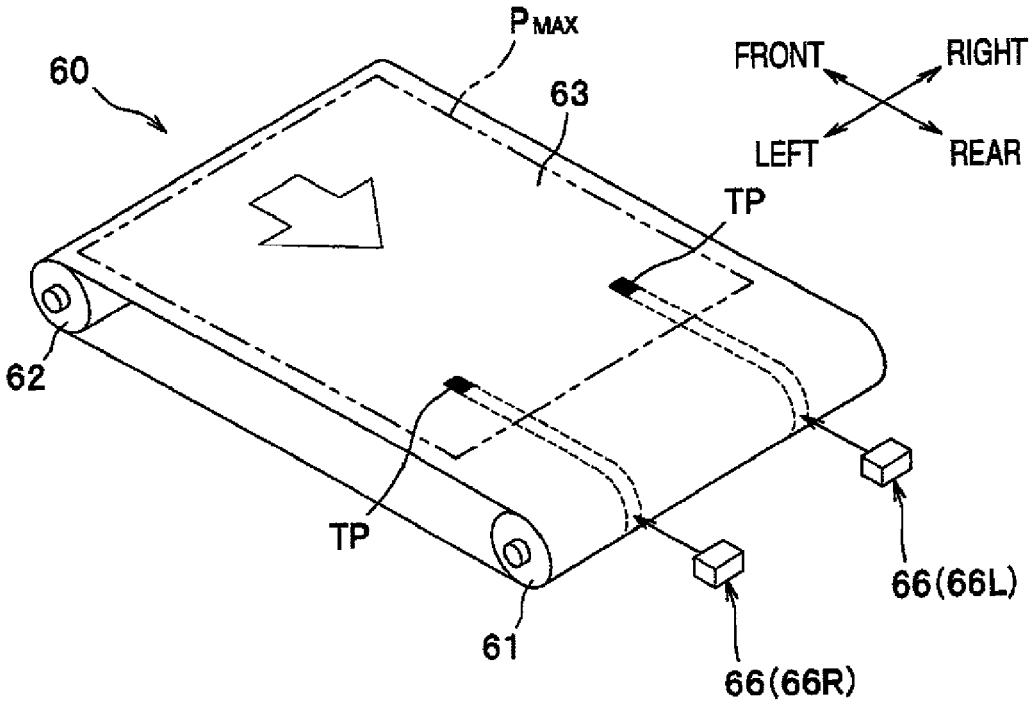
FIG. 3 is a perspective view of a transfer unit in the color printer according to the embodiment of the present invention.

The LED units 40 and the processing units 50 can serve in cooperation to form patterns of images, i.e., test patterns TP (see FIG. 3), which are toner images to be formed on the conveyer belt 63 and used to correct color discrepancy, on the conveyer belt 63, in a behavior similar to the image forming behavior of the LED units 40 and the processing units 50 to form an image on the recording sheet P.

More specifically, each LED unit 40 and each processing unit 50 being a pair form test patterns TP on an upper surface of the conveyer belt 63 in positions closer to widthwise ends of a recording sheet Pmax in a maximum-allowable width size. The maximum-allowable width size of the recording sheet P is a largest allowable width of the recording sheet P to be processed in the color printer 1, and the maximum-allowable width-sized recording sheet P has a largest allowable width to be processed in the color printer 1. The maximum-allowable width-sized recording sheet Pmax is indicated in a double-dotted line in FIG. 3. Each pair of the LED unit 40 and the processing unit 50 forms the test patterns TP, and successively formed test patterns TP formed by a following pair of LED unit 40 and the processing unit 50 closer to the rear of the color printer 1 are laid over the previously formed test patterns TP.

Transfer Unit

The transfer unit 60 includes two misalignment detectable sensors 66 in addition to the driving roller 61, the driven roller 62, and the conveyer belt 63. The misalignment detectable sensor 66 includes a right-side misalignment detectable sensor 66R and a left-side misalignment detectable sensor 66L.

The misalignment detectable sensors 66 are known optical reflective sensors, each of which has a light-emitter and a light-receiver. The misalignment detectable sensors 66 in the transfer unit 60 are arranged in the vicinities of the rear end of and in a left-side portion and a right-side portion in the conveyer belt 63, and in positions to oppose the rear-end portion of the conveyer belt 63. The misalignment detectable sensors 66 can detect the test patterns TP formed on the conveyer belt 63 based on differences in strengths and wavelengths of light reflected on the test patterns TP and on the surface of the conveyer belt 63.

According to the present embodiment, the color printer 1 corrects color discrepancy of an image to be formed in the image forming unit 30 based on the outputs from the misalignment detectable sensors 66. In particular, when the misalignment detectable sensor 66 detects misalignment (i.e., color discrepancy) of four test patterns, each of which was formed on the surface of the conveyer belt 63 by the pair of the LED unit 40 and the processing unit 50, the controller unit 120 (see FIG. 2) can correct the color discrepancy by, for example, adjusting timings of exposure of the photosensitive drum 51 to the LED unit 40. The technique to correct color discrepancy is known; therefore, description of that will be omitted.

The misalignment detectable sensors 66 according to the present embodiment can detect the recording sheet P being carried by the conveyer belt 63 when judgment is made as to whether the recording sheet P is in one-sided alignment. The misalignment detectable sensors 66 can be switched between a pattern-detectable mode, in which the misalignment detectable sensors 66 can detect the test patterns TP on the conveyer belt 63 in order to correct color discrepancy, and a carried-sheet detectable mode, in which the misalignment detectable sensors 66 can detect the recording sheet P being carried above the misalignment detectable sensors 66 in order to determine one-sided alignment of the recording sheet P.

Figure 4A:
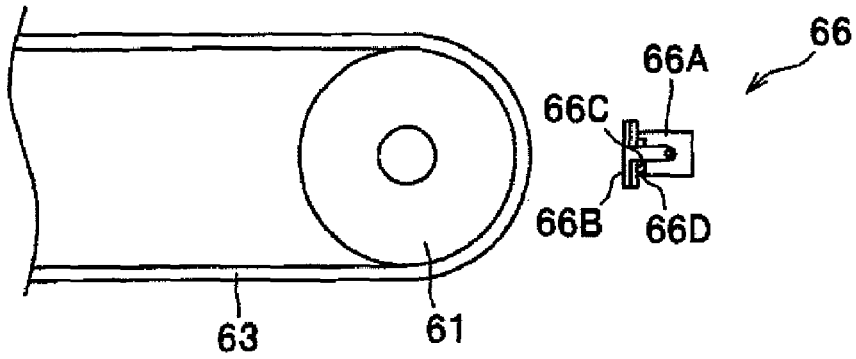
FIGS. 4A-4C illustrates behaviors of a misalignment detectable sensor in the color printer according to the embodiment of the present invention.

Each of the misalignment detectable sensors 66 is provided with a sensor 66A having a light-emitter and a light-receiver, a rotatable cover 66B, and a mirror 66C. The mirror 66C is arranged in the rotatable cover 66B in a position to oppose the sensor 66A. As shown in FIG. 4A, when the misalignment detectable sensor 66 is not in use, such as when the color printer 1 is in a ready state or in an image forming operation, the cover 66B is in a position between the sensor 66A and the conveyer belt 63 to cover a detectable surface 66D of the sensor 66A so that the detectable surface 66D of the sensor 66A is prevented from being exposed to the toner and other adhesive materials in the atmosphere. The detectable surface 66 of the sensor 66A includes a light-emitting surface and a light-receiving surface.

Figure 4B:
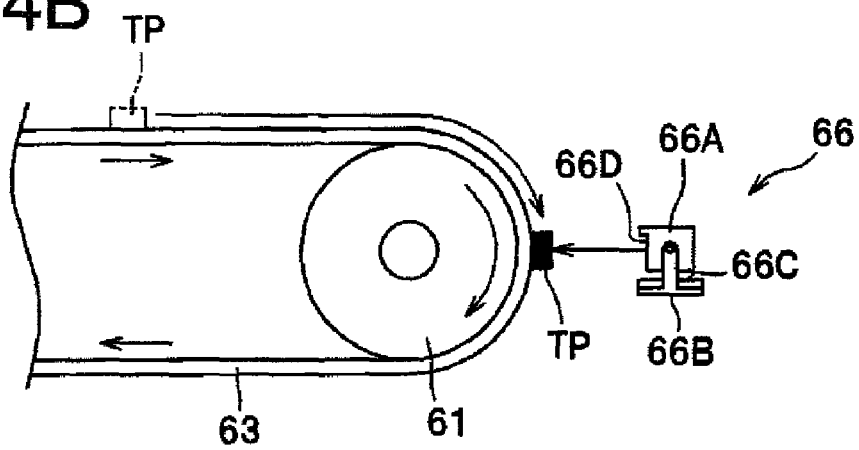

When the misalignment detectable sensor 66 is used to detect misalignment of the test patterns TP, the misalignment detectable sensor 66 is shifted in the pattern-detectable mode. In the pattern-detectable mode, as shown in FIG. 4B, the cover 66B is rotated at a predetermined first angle to expose the detectable surface 66D of the sensor 66A to the rear end of the conveyer belt 63 so that the light-emitter emits light from the detectable surface 66D to the conveyer belt 63 and the light reflected on the conveyer belt 63 is received in the light-receiver.

Figure 4C:
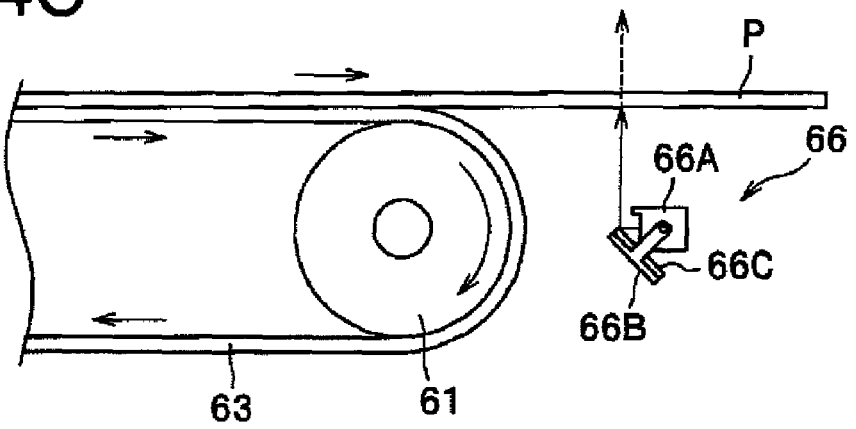

When the misalignment detectable sensor 66 is used to determine the one-sided alignment of the recording sheet P, the misalignment detectable sensor 66 is shifted in the carried-sheet detectable mode. In the carried-sheet detectable mode, as shown in FIG. 4C, the cover 66B is rotated at a predetermined angle which is smaller than the first angle of the cover 66B in the pattern-detectable mode. In this position in the carried-sheet detectable mode, the light emitted from the detectable surface 66D is reflected on the mirror 66C and angled upward. With the cover 66B at the second angle, when the recording sheet P is in the feeding path above the misalignment detectable sensor 66, the angled light is reflected on the recording sheet P, reflected on the mirror 66C, and received in the light-receiver in the detectable surface 66D. Thus, presence of the recording sheet P being carried above the misalignment detectable sensor 66 is detected. With the cover 66B in the second angle, but when the recording sheet P is not in the feeding path above the misalignment detectable sensor 66, the light from the light-emitter is not reflected, as indicated by a dotted arrow in FIG. 4C, to be received in the light-receiver. Thus, absence of the recording sheet P is detected.

According to the present embodiment, the right-side misalignment detectable sensor 66R is arranged in a position, in which a right-side portion of the maximum-allowable width-sized recording sheet Pmax is detectable thereby, and the left-side misalignment detectable sensor 66L is arranged in a position, in which a left-side portion of the maximum-allowable width-sized recording sheet Pmax is detectable thereby, when the maximum-allowable width-sized recording sheet Pmax is carried in the feeding path above the right and left-side misalignment detectable sensors 66R, 66L.

The misalignment detectable sensors 66 may be controlled to, for example, emit different intensities of light depending on the detectable mode (i.e., the pattern-detectable mode and the carried-sheet detectable mode). Alternatively or additionally, sensitivities of the light-receivers may be adjusted depending on the detectable mode.

Fixing Unit

Figures 5A, 5B:
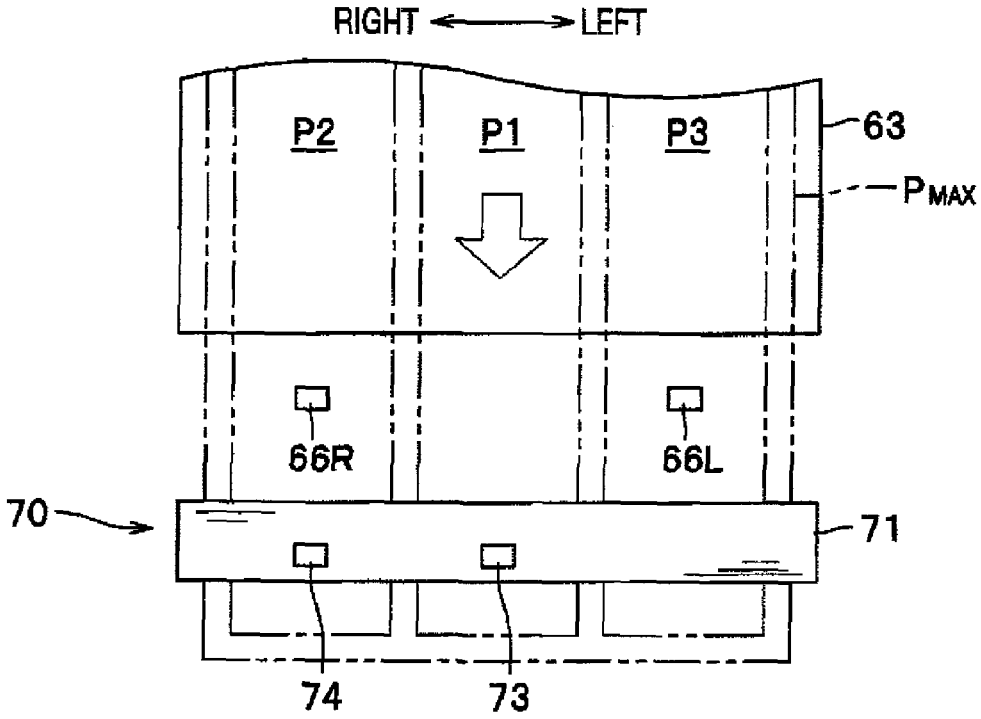
FIG. 5A illustrates sheet-feeding behaviors in the color printer according to a first embodiment of the present invention.
FIG. 5B is a table to illustrate criteria to judge one-sided alignment of the sheet and judgment results to be derived in the color printer according to the first embodiment of the present invention.

The fixing unit 70 as shown in FIG. 5A includes a temperature-control sensor 73 and an overheat detectable sensor 74 being a heat sensor in addition to the heat roller 71 and the pressure roller 72.

In the present embodiment, the overheat detectable sensor 74 being a heat sensor refers to a sensor detectable of a plurality of different temperatures in a predetermined temperature range (e.g., a thermistor) and does not include a breaker or an interrupter such as a thermostat or a fuse which blocks power to a heater (e.g., a halogen lamp) in response to a predetermined temperature.

The temperature-control sensor 73 is arranged in the vicinity of and above an axial center of the heat roller 71 and detects temperature of a circumferential surface of the heat roller 71. The temperature in the heat roller 71 is controlled in the color printer 1 based on the sensed result detected by the temperature-control sensor 73. The configuration to control the temperature is known; therefore, description of that is herein omitted.

The overheat detectable sensor 74 is arranged in a position in the vicinity of and above one of the axial ends of the heat roller 71 closer to the right-side end in the widthwise direction. Thus, the overheat detectable sensor 74 detects temperature of a circumferential surface of the right-side portion of the heat roller 71. The fixing unit 70 according to the present embodiment does not have an overheat detectable sensor to detect temperature of a circumferential surface of a left-side portion of the heat roller 71.

More specifically, the overheat detectable sensor 74 is in a position above the heat roller on an outer side of the right-side end of a minimum-allowable width-sized recording sheet P (i.e., P1 in FIG. 5A) being carried in the centered alignment. Meanwhile, no overheat detectable sensor is provided in a position above the heat roller 71 on an outer side of the left-side end of the minimum-allowable width-sized recording sheet P1 being carried in the centered alignment.

When the overheat detectable sensor 74 detects excessive heat in the heat roller 71, the controller unit 120 in the color printer 1, for example, shuts down power to a heat generator to heat the circumferential surface of the heat roller 71 so that the temperature in the heat roller 71 is prevented from being further increased. According to the present embodiment, when the heat generation in the heat roller 71 is ceased, the informer unit 80 informs the user of alert concerning the excessive heat in the heat roller 71 by, for example, an alarm sound.

Further, if the color printer 1 is in an image forming operation when the heat generation in the heat roller 71 is ceased, the controller unit 120 of the color printer 1 ejects the recording sheet P in the feeding path and aborts the image forming behaviors. If the color printer is not in an image forming operation, the control unit 120 controls the color printer 1 not to start a new image forming operation even if the user's instruction to start the image forming operation is entered. The above behaviors of the control unit 120 are a known controlling method to prevent failure in the image forming apparatus. In the present embodiment, an operation mode, in which the color printer 1 operates in the controlling method, is referred to as a normal mode.

Judging the One-Sided Alignment

Next, a method to judge the one-sided alignment of the recording sheet P by the judging unit 110 will be described. Judging starts when the image data to be printed is inputted in the color printer 1.

When the image data is inputted, the covers 66B in the misalignment detectable sensors 66 are rotated at the second angle (see FIG. 4C), and the misalignment detectable sensors 66 are shifted in the carried-sheet detectable mode. Thereafter, the recording sheet P is fed by the feeder unit 20 to have the image formed thereon in the image forming unit 30 (see FIG. 5A). The controller unit 110 judges as to whether the recording sheet P being carried above the right and left-side misalignment detectable sensors 66R, 66L is detected by the right and left-side misalignment detectable sensors 66R, 66L within a predetermined time period, which starts, for example, upon judgment of one-sided alignment of the recording sheet P or upon start feeding of the recording sheet P, and ends, for example, upon completion of discharge of the recording sheet P.

The judging unit 110 determines that the recording sheet P is in the one-sided alignment when solely one of the right and left-side misalignment detectable sensors 66 detects the recording sheet P being carried.

In particular, as shown in FIGS. 5A and 5B, if the maximum-allowable width-sized recording sheet Pmax is carried in the feeding path, the right-side portion and the left-side portion of the recording sheet Pmax are detected by the right and left-side misalignment detectable sensors 66R, 66L respectively within the predetermined time period. (The recording sheet Pmax in the maximum-allowable width-sized may be, for example, a letter-sized paper.) Accordingly, affirmative (+) judgments are made for the results detected by the right and left-side misalignment detectable sensors 66R, 66L. Thus, the judging unit 110 determines that the recording sheet P is not fed in the one-sided alignment but fed in the centered alignment (i.e., judgment "CENTER" is made).

In the color printer 1, meanwhile, a smaller width-sized recording sheet P, which has a smaller width than the width of the maximum-allowable width-sized recording sheet Pmax, may be carried. The recording sheet P in the smaller width may be, for example, a postcard. When the smaller width-sized recording sheet (e.g., P1 in FIG. 5A) is carried normally in the centered alignment, the recording sheet P1 is carried between the right and left-side misalignment detectable sensors 66R, 66L. Therefore, the recording sheet P1 being carried is detected by neither the right-side misalignment detectable sensor 66R nor the left-side misalignment detectable sensor 66L, and negative (−) judgments are made for the results detected by the right and left-side misalignment detectable sensors 66R, 66L. Based on the negative judgments, the judging unit 110 determines that the recording sheet P1 is not fed in the one-sided alignment but fed in the centered alignment (i.e., judgment "CENTER" is made).

When the smaller width-sized recording sheet P (e.g., P2) is carried in the one-sided alignment, specifically, aligned to the right-side end of the feeding path, the recording sheet P2 being carried is solely detected by the right-side misalignment detectable sensor 66R and not by the left-side misalignment detectable sensor 66L. Accordingly, affirmative (+) judgment is made for the right-side misalignment detectable sensor 66R, and negative (−) judgment is made for the left-side misalignment detectable sensor 66L. Based on the results, the judging unit 110 determines that the recording sheet P2 is fed in the one-sided alignment (i.e., judgment "ONE-SIDE" is made).

When the smaller width-sized recording sheet P (e.g., P3) is carried in the one-sided alignment, specifically, aligned to the left-side end of the feeding path, the recording sheet P3 being carried is not detected by the right-side misalignment detectable sensor 66R but solely by the left-side misalignment detectable sensor 66L. Accordingly, negative (−) judgment is made for the right-side misalignment detectable sensor 66R, and affirmative (+) judgment is made for the left-side misalignment detectable sensor 66L. Based on the results, the judging unit 110 determines that the recording sheet P3 is fed in the one-sided alignment (i.e., judgment "ONE-SIDE" is made).

It is to be noted that the judgment of the sheet alignment can be made on basis of the recording sheet P or in predetermined timings. For example, the judgment may be made for the first page in the printing operation or for every time a predetermined number of pages are fed.

Controlling Flow after Judgment

Next, a flow to control the color printer 1 after the judgment made by the judging unit 110 will be described.

If the recording sheet P3 is carried in the one-sided alignment and aligned to the left-side end of the feeding path, which is the side having no overheat detectable sensor thereon, the right-side portion of the heat roller 71 may be excessively heated. However, the excessively increased temperature can be detected by the overheat detectable sensor 74. Therefore, the image forming operation can be continued in the normal mode as it is continued with the recording sheet P1 and Pmax, and the heat roller 71 can be avoided from being overheated.

Meanwhile, if the recording sheet P2 is carried in the one-sided alignment aligned to the right-side end of the feeding path, which is the side having the overheat detectable sensor 74 thereon, the left-side portion of the heat roller 71 may be excessively heated. Because the left-side portion of the heat roller 71 is not provided with the overheat detectable sensor, the excessively increased temperature is not detectable. Accordingly, if the image forming operation is continued with the excessively heated heat roller 71, the bearings to hold the heat roller 71 may melt and be deformed.

Therefore, when the judging unit 110 judges that the recording sheet P2 is fed in the one-sided alignment based on the recording sheet P2 being carried solely detected by the right-side misalignment detectable sensor 66R, the controller unit 120 controls the color printer 1 to restrict the temperature of the heat roller 71 from being further increased.

In other words, when the judging unit 110 judges that the recording sheet P being carried is in the one-sided alignment based on the results indicating that solely the right-side misalignment detectable sensor 66R detects the recording sheet P and the left-side misalignment detectable sensor 66L detects absence of the recording sheet P, the controller unit 120 controls the color printer 1 to enter a heat-restriction mode, in which the temperature of the heat roller 71 is prevented from being further increased regardless of the result detected by the overheat detectable sensor 74. Further, in the heat-restriction mode, the controller unit 120 may control the informer unit 80 to inform the user of alert concerning the one-sided alignment of the recording sheet P by, for example, displaying a message and generating an alarm sound.

The heat in the heat roller 71 can be prevented from being further increased by, for example, ceasing the heat generation in the heat roller 71, similarly to the case in which the overheat detectable sensor 74 detects the excessive heat. In this regard, if the color printer 1 is in the image forming operation, the operation is ceased as well. The heat generation in the heat roller 71 may be ceased immediately or after the images are formed on a predetermined number of recording sheets P. Alternatively, the image forming operation may be continued with decreased temperature in the heat roller 71.

For another example, the heat in the heat roller 71 can be prevented from being further increased by lowering an image forming speed of the color printer 1. When the image forming speed is lowered, a rotation speed of the heat roller 71 is lowered accordingly, and the temperature can be distributed in the heat roller 71 due to thermal migration. Thus, partial increase of the temperature within the heat roller 71 can be prevented.

For another example, the heat in the heat roller 71 can be prevented from being further increased by lowering a threshold temperature for the heat roller 71, which is referred to when overheat in the heat roller 71 is determined When the smaller width-sized recording sheet P is in the one-sided alignment aligned to the right (i.e., when the recording sheet P is fed in the position of P2 in FIG. 5A), the right-side portion of the heat roller 71 releases heat to the recording sheet P2 being fed, and the temperature in the right-side portion of the heat roller 71 tends not to be increased. However, during an image forming operation with a plurality of recording sheets P2 being fed, the temperature may still be increased moderately. Therefore, based on preliminarily determined correlationship between the temperature at the left-side portion and the right-side portion of the heat roller 71 with the recording sheets P2 in the one-sided alignment aligned to the right side in the feeding path, the temperature of the left-side portion of the heat roller 71 may be estimated with reference to the temperature in the right-side portion of the heat roller 71. Thus, excessively increased temperature in the left-side portion of the heat roller 71 can be determined rather indirectly. When the overheat detectable sensor 74 indirectly detects the excessively increased temperature in the left-side portion of the heat roller 71, heat generation in the heat roller 71 is ceased, similarly to the controlling flow in the normal mode.

Figure 6:
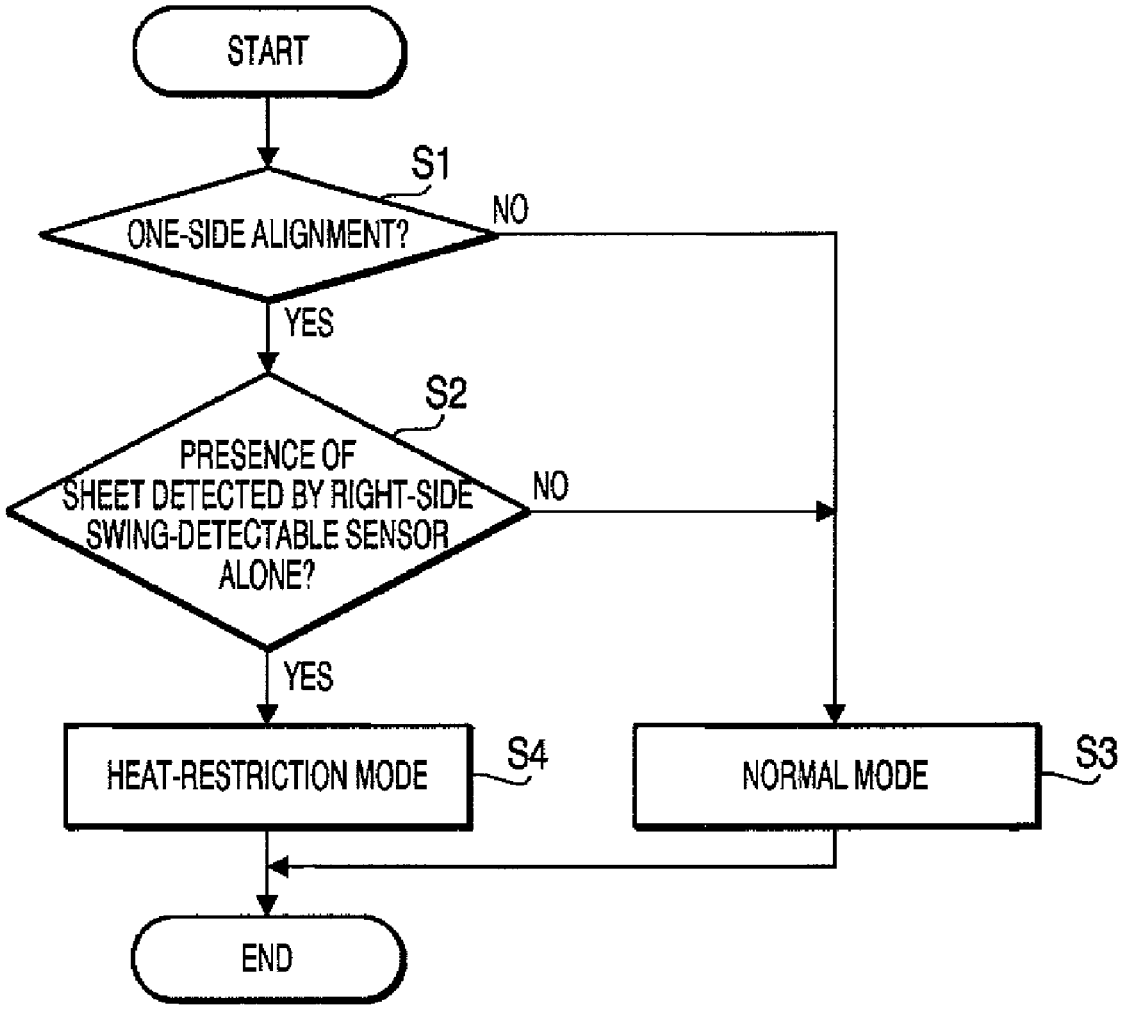
FIG. 6 is a flowchart to illustrate a controlling flow to control the color printer according to the embodiment of the present invention.

The judgment to be made by the judging unit 110 and the controlling flow after the judgment are described with reference to a flowchart shown in FIG. 6. When judging starts, in S1, the controller device 100 judges as to whether the recording sheet P is in the one-sided alignment. If the recording sheet P is in the centered alignment (S1: NO), in S3, the controller device 100 continues to control the color printer 1 in the normal mode. In the normal mode, if the overheat detectable sensor 74 detects excessively increased heat in the heat roller 71 when, for example, smaller width-sized recording sheets P (e.g., the recording sheet P1 in FIG. 5A) are fed in the centered alignment, the controller device 100 ceases the heat generation in the heat roller 71 and controls the informer unit 80 to inform the user of alert concerning the overheat in the heat roller 71.

In S1, if the recording sheet P is in the one-sided alignment (S1: YES), in S2, the controller device 100 determines as to whether the judgment was made based on the recording sheet P being detected by the right-side misalignment detectable sensor 66R alone and that no presence of the recording sheet P was detected by the left-side misalignment detectable sensor 66L.

In S2, if the judgment was made based on the recording sheet P being detected by the left-side misalignment detectable sensor 66L alone and that absence of the recording sheet P was detected by the right-side misalignment detectable sensor 66R (S2: NO), in S3, the controller device 100 continues to control the color printer 1 in the normal mode.

In S2, meanwhile, if the judgment was made based on the recording sheet P being detected by the right-side misalignment detectable sensor 66R alone and that absence of the recording sheet P was detected by the left-side misalignment detectable sensor 66L (S2: YES), in S4, the controller device 100 enters the heat-restriction mode, in which the heat in the heat roller 71 is prevented from being further increased regardless of the result detected by the overheat detectable sensor 74.

According to the color printer 1 in the above configuration, it is to be noted that the misalignment detectable sensors 66, which have been provided in conventional printers to detect color discrepancy of images to be formed, are utilized to determine the alignment of the recording sheets P. In the color printer 1 in the above embodiment, therefore, the one-sided alignment of the recording sheet P can be easily detected without additional sensors to specifically detect the one-sided alignment of the recording sheet P in the feeding path or in the feeder unit 20. In other words, the one-sided alignment of the recording sheet P can be detected whilst manufacturing cost of the color printer 1 is prevented from being largely increased.

In the above embodiment, the judging unit 110 determines that the recording sheet P is in the one-sided alignment when solely one of the misalignment detectable sensors 66 detects presence of the recording sheet P being fed and the other of the misalignment detectable sensors 66 detects absence of the recording sheet P. Therefore, to which side the recording sheet P is aligned can be detected. Thus, the color printer 1 is controlled to effectively behave in accordance with the side to which the recording sheet P is aligned.

In the above embodiment, further, the misalignment detectable sensors 66 are switchable between the pattern-detectable mode and the carried-sheet detectable mode by use of the mirror 66C; therefore, even though the misalignment detectable sensors 66 may be in positions, in which the misalignment detectable sensors 66 cannot detect the conveyer belt 63 with the test patterns TP and the recording sheet P on the conveyer belt 63 simultaneously, the test patterns TP and the recording sheet P are detectable, when present, by the mode-switched misalignment detectable sensors 66. In this regard, detection of the test patterns TP and the recording sheet P is available without largely modifying the arrangement of the components within the color printer 1. According to the color printer 1 in the above configuration, the misalignment detectable sensors 66, which have been provided in conventional printers to detect color discrepancy of images to be formed, are utilized to determine the alignment of the recording sheets P. In the color printer 1 in the above embodiment, therefore, the one-sided alignment of the recording sheet P can be easily detected without additional sensors to detect the one-sided alignment of the recording sheet P in the feeding path or in the feeder unit 20. In other words, the one-sided alignment of the recording sheet P can be detected whilst manufacturing cost of the color printer 1 is prevented from being largely increased.

In the above embodiment, the controlling flow, in which the color printer 1 is shifted to operate in the heat-restriction mode when the right-side misalignment detectable sensor 66R alone detects the presence of the recording sheet P being carried and the left-side misalignment detectable sensor 66L does not detect the recording sheet P, is illustrated. However, the color printer 1 may not necessarily be shifted to operate in the heat-restriction mode immediately. Rather, for example, when the right-side misalignment detectable sensor 66R alone detects the recording sheet P and it is determined that the recording sheet P is in the one-sided alignment, the controller device 100 may manipulate the informer unit 80 to inform the user of alert concerning the one-sided alignment. When, for example, the user corrects the alignment of the recording sheet P to the centered-alignment, the image forming operation may resume. Alternatively, if the user does not correct the alignment of the recording sheet P but the one-sided alignment is maintained for a predetermined time period, the heat in the heat roller 71 can be prevented from being further increased after the predetermined time period.

In the above embodiment, the controlling flow, in which the controller device 100 shifts the color printer 1 to operate in the heat-restriction mode when the recording sheet P is in the position illustrated as P2 in FIG. 5A and maintains the color printer 1 to operate in the normal mode when the recording sheet P is in the position illustrated as P3. However, the controller device 100 may, for example, shift the color printer 1 to operate in the heat-restriction mode regardless of the side on which the recording sheet P is as long as the recording sheet P is in the one-sided alignment.

According to the above embodiment, presence of the recording sheet P being carried is detected by the misalignment detectable sensors 66 receiving the light reflected on the recording sheet P when the misalignment detectable sensors 66 are in the carried-sheet detectable mode (see FIG. 4C). Thereby, based on continuous receipt of the reflected light (i.e., between the initial detection of the reflected light and discontinued receipt of the light), a time period, in which the recording sheet P passes above the misalignment detectable sensors 66, can be obtained. In consideration of these features, the controller device 100 may estimate a length of the recording sheet P, which extends in the front-rear direction in the color printer 1, based on the obtained time period and a feeding speed in the color printer 1. When the length of the recording sheet P is obtained, for example, the color printer 1 can judge as to whether the recording sheet P is in a correct size with respect to the image to be printed based on a predetermined sheet size corresponding to the image. Further, for another example, the controller device 100 may determine as to whether a recording sheet P with a smaller width and a larger length, which tend to increase the heat in the heat roller 71, is used in the image forming operation. When such a recording sheet P is being used, the controller device 100 may manipulate the informer unit 80 to inform the user of the alert.

Second Embodiment

Next, a second embodiment of the present invention will be described with reference to FIGS. 7A, 7B. In the description below, components and behaviors of the color printer identical to those in the first embodiment will be referred to by identical reference signs, and explanation of those will be omitted.

Figures 7A, 7B:
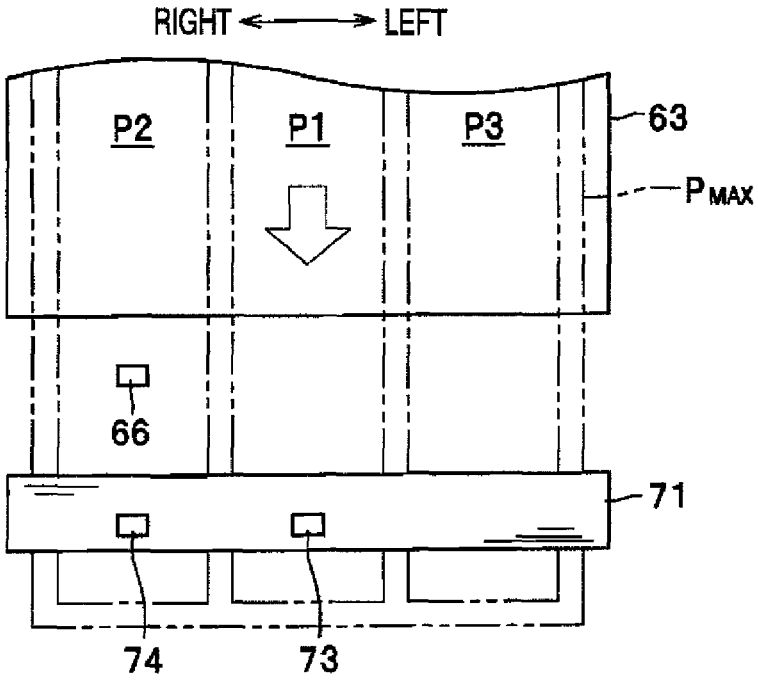
FIG. 7A illustrates sheet-feeding behaviors in the color printer according to a second embodiment of the present invention.
FIG. 7B is a table to illustrate criteria to judge misalignment of the sheet and judgment results to be derived in the color printer according to the second embodiment of the present invention.

As shown in FIG. 7A, the fixing unit 70 according to the second embodiment is provided with solely one misalignment detectable sensor 66, which detects a right-side portion of a maximum-allowable width-sized recording sheet Pmax with the maximum-allowable width being carried by the conveyer belt 63 in the feeding path.

The overheat detectable sensor 74 is arranged in a position to detect the temperature in the vicinity of and above one of the axial ends of the heat roller 71 closer to the right-side end in the widthwise direction. Thus, the overheat detectable sensor 74 detects temperature of the circumferential surface of the right-side portion of the heat roller 71. The fixing unit 70 does not have an overheat detectable sensor to detect temperature of the circumferential surface of the left-side portion of the heat roller 71.

Figure 2:
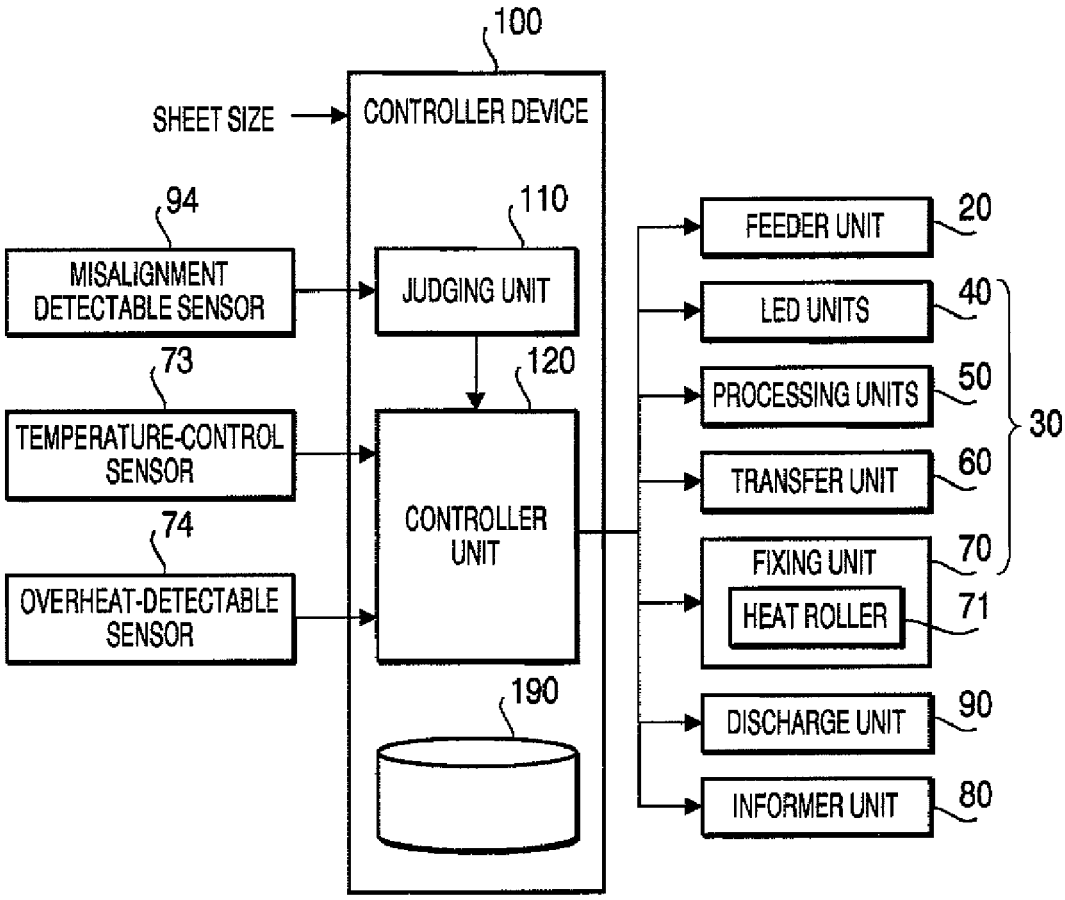
FIG. 2 is a block diagram to illustrate overall configuration of the color printer according to the embodiment of the present invention.

In the present embodiment, information concerning a sheet size (e.g., a maximum-allowable width-size or a smaller-width size) of the recording sheet P to be used is entered in the controller device 100 prior to the judgment to be made by the judging unit 110 (see FIG. 2).

The information concerning the sheet size is, for example, included in the image data inputted in the controller device 100 of the color printer prior to the judgment of one-sided alignment. In other words, the sheet size information can be entered along with the image data. Optionally, the sheet size information may be entered by the user manipulating the color printer 1. The user may select one of sheet size options or directly enter a suitable size for the image to be printed. Alternatively, if the color printer 1 is equipped with a known sensor to determine a sheet size for the image to be printed, the sheet size information may be provided by the sensor.

When the image data is inputted, the misalignment detectable sensor 66 is shifted in the carried-sheet detectable mode, and the cover 66B in the misalignment detectable sensor 66 is rotated at the second angle (see FIG. 4C). Thereafter, the recording sheet P is carried by the feeder unit 20 in the feeding path on the conveyer belt 63 (see FIG. 7A). The controller unit 110 judges as to whether the recording sheet P being carried above the misalignment detectable sensor 66 is detected by the misalignment detectable sensor 66 within a predetermined time period, which starts, for example, upon judgment of one-sided alignment of the recording sheet P or upon start of feeding the recording sheet P, and ends, for example, upon completion of discharge of the recording sheet P.

The judging unit 110 determines that the recording sheet P is in the one-sided alignment when the sheet size information indicating the sheet size for the current image data is a smaller width-sized recording sheet P and the misalignment detectable sensor 66 detects (+) the recording sheet P being carried.

In particular, as shown in FIGS. 7A and 7B, if the maximum-allowable width-sized recording sheet Pmax is carried in the feeding path, presence of the recording sheet Pmax is detected (+) by the misalignment detectable sensor 66 within the predetermined time period. In this regard, according to the sheet size information, the sheet size being carried for the current image data indicates the maximum-sized recording sheet Pmax; therefore, the judging unit 110 determines that the recording sheet P is not fed in the one-sided alignment but fed in the centered alignment (i.e., judgment "CENTER" is made).

Meanwhile, when the smaller width-sized recording sheet is carried normally in the centered alignment in the position P1 or in the one-sided alignment in the position of P3 closer to the left-side end of the feeding path, on which no overheat detectable sensor is provided, the recording sheet P is not detected (−) by the misalignment detectable sensor 66 within the predetermined time period. Accordingly, the judging unit 110 determines that the recording sheet P is not fed in the one-sided alignment but fed in the centered alignment (i.e., judgment "CENTER" is made).

When the smaller width-sized recording sheet P is in the position P3, and if judgment is made that the recording sheet P is in the centered alignment, excessively increased heat in the heat roller 71 can be detected by the overheat detectable sensor 74. Therefore, even with the judgment of the centered alignment, the heat in the heat roller 71 can be controlled without a problem.

When the smaller width-sized recording sheet P is fed in the one-sided alignment in the position P2, closer to the right-side end of the feeding path, on which the overheat detectable sensor 74 is provided, the misalignment detectable sensor 66 detects (+) the recording sheet P being carried within the predetermined time period. Further, based on the sheet size information indicating the smaller-width size, the judging unit 110 determines that the recording sheet P is fed in the one-sided alignment (i.e., judgment "ONE-SIDE" is made). Accordingly, the controller unit 120 controls the color printer 1 to enter a heat-restriction mode.

According to the second embodiment, the one-sided alignment of the recording sheet P, specifically aligned to the side on which the overheat detectable sensor 74 is provided, can be detected even with solely one misalignment detectable sensor 66. That is, the one-sided alignment of the recording sheet P can be detected with a smaller quantity (e.g., one) misalignment detectable sensor 66, and manufacturing cost for the color printer 1 can be reduced.

Although examples of carrying out the invention have been described, those skilled in the art will appreciate that there are numerous variations and permutations of the image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, in the above embodiments, the cover 66B in the misalignment detectable sensor 66 is rotated between the first angle (see FIG. 4B) and the second angle (see FIG. 4C) to switch and the misalignment detectable sensor 66 between the pattern-detectable mode and the carried-sheet detectable mode. However, the misalignment detectable sensor may be in a different configuration, such as misalignment detectable sensors 166, 266, which are shown in FIGS. 8A, 8B and 9A, 9B.

Figure 8A:
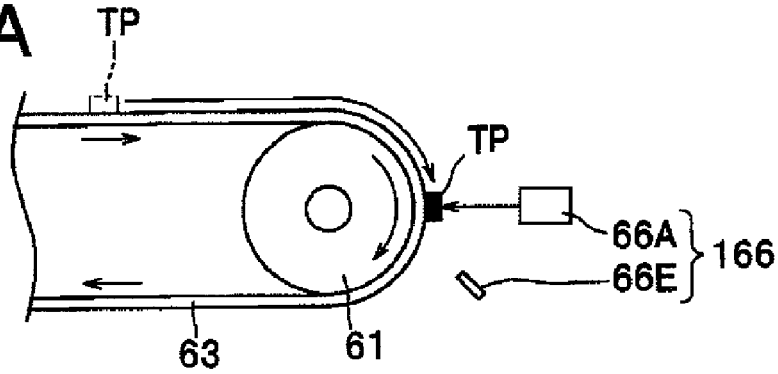
FIGS. 8A and 8B illustrate behaviors of the misalignment detectable sensor in the color printer according to a modified embodiment of the present invention.
Figure 8B:
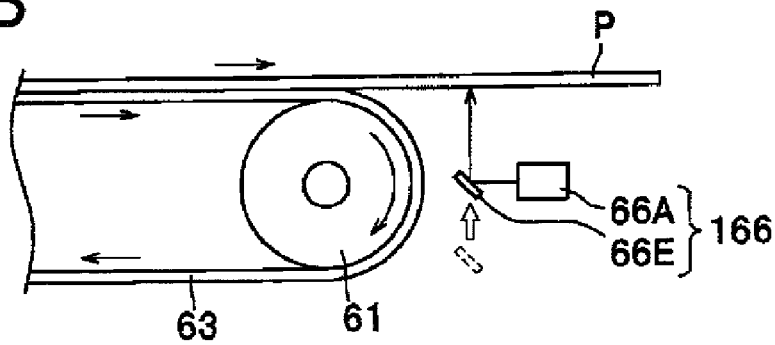

The misalignment detectable sensor 166 shown in FIGS. 8A, 8B includes the sensor 66A and a movable mirror 66E, which can be shifted vertically between a lower position and an upper position. When the misalignment detectable sensor 166 is in the pattern-detectable mode, the movable mirror 66E is in the lower position (see FIG. 8A) so that the light from the light-emitter reaches the test pattern TP. When the misalignment detectable sensor 166 is in the carried-sheet detectable mode (see FIG. 8B), the movable mirror 66E is lifted upward to the upper position between the sensor 66A and the conveyer belt 63 so that the light emitted from the light-emitter is reflected on the movable mirror 66E to be directed upward and reflected on the recording sheet P. The reflection from the recording sheet P is thus received by the sensor 66A.

Figure 9A:
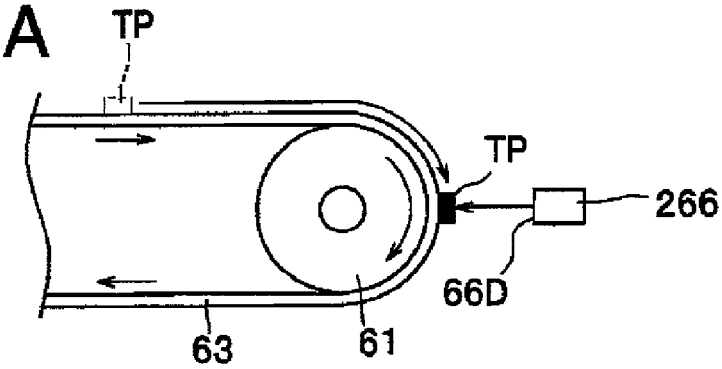
FIGS. 9A and 9B illustrate behaviors of the misalignment detectable sensor in the color printer according to a modified embodiment of the present invention.
Figure 9B:
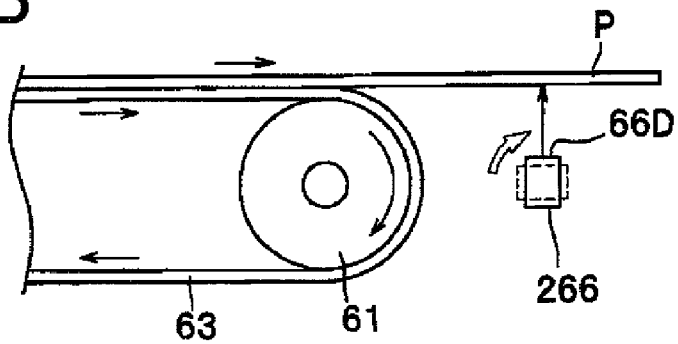

The misalignment detectable sensor 266 shown in FIGS. 9A, 9B is rotatable and includes a detectable plane 66D. When the misalignment detectable sensor 266 is in the pattern-detectable mode (see FIG. 9A), the misalignment detectable sensor 266 is rotated to have the detectable plane 66D to face the rear-end portion of the conveyer belt 63 so that the light from the light-emitter reaches the test pattern TP on the conveyer belt 63. When the misalignment detectable sensor 266 is in the carried-sheet detectable mode (see FIG. 9B), the misalignment detectable sensor 266 is rotated upward to have the detectable plane 66D to face the feeding path. Thus, presence the recording sheet P can be detected.

Figure 10:
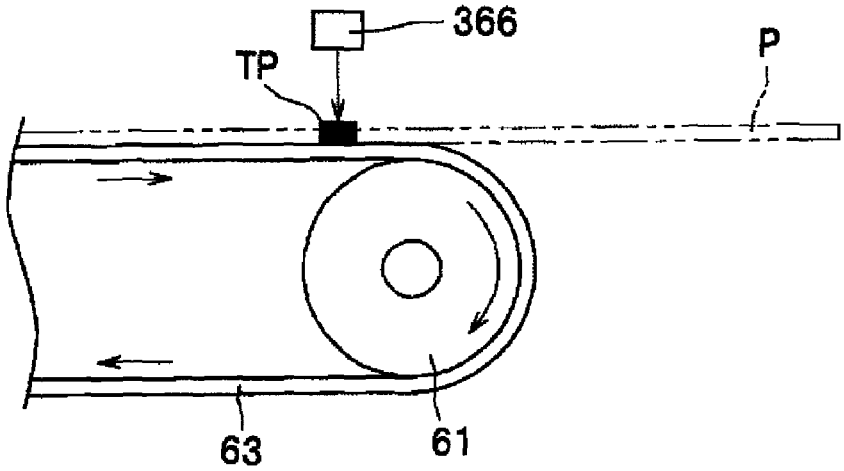
FIG. 10 illustrates the misalignment detectable sensor in a different position in the color printer according to a modified embodiment of the present invention.

In the above embodiments, the misalignment detectable sensors 66 are arranged in the vicinities of the rear-end portion of the conveyer belt 63, however, positions of the misalignment detectable sensors 66 are not limited. For example, a known optical-reflective misalignment detectable sensor 366 (see FIG. 10) may be arranged in a position above the conveyer belt 63 with the feeding path (i.e., the recording sheet P when present) in-between. In this position, the misalignment detectable sensor 366 can detect the test pattern TP on the conveyer belt 63 and presence of the recording sheet P without rotating the cover 66B, the movable mirror 66E, or the detective plane 66D. Accordingly, configuration in the color printer 1 concerning the misalignment detectable sensor 366 can be simplified.

In the above embodiments, the fixing unit 70 includes the heat roller 71 and the pressure roller 72. However, the heat roller 71 may be replaced with, for example, a heater formed in a film, and the pressure roller 72 may be replaced with a belt-formed presser.

In the above embodiments, the fixing unit 70 is provided with two separate temperature sensors, which are the temperature-control sensor 73 and the overheat detectable sensor 74. However, the fixing unit 70 may be provided with, for example, solely one temperature sensor which can detect the temperature in the heat roller 71 serve as the temperature-control sensor 73 and the overheat detectable sensor 74 concurrently.

The conveyer belt 63 described in the above embodiments may be replaced with, for example, an intermediate transfer belt or a photosensitive belt. When an intermediate transfer belt is employed in place of the conveyer belt 63, the toner images formed on the surfaces of the photosensitive drums 51 in different colors are transferred to be overlaid on a surface of the intermediate transfer belt. When the recording sheet P is carried in between the intermediate transfer belt and a secondary transfer roller, the overlaid toner images are further transferred onto the recording sheet P. When a photosensitive belt is employed in place of the conveyer belt 63, the latent images, formed on a surface of the photosensitive belt being exposed to the light from the LED units 40, are provided with toners so that the toner images formed on the photosensitive belt are transferred to the recording sheet P when the recording sheet P is carried in between the photosensitive belt and a transfer roller.

Figure 11:
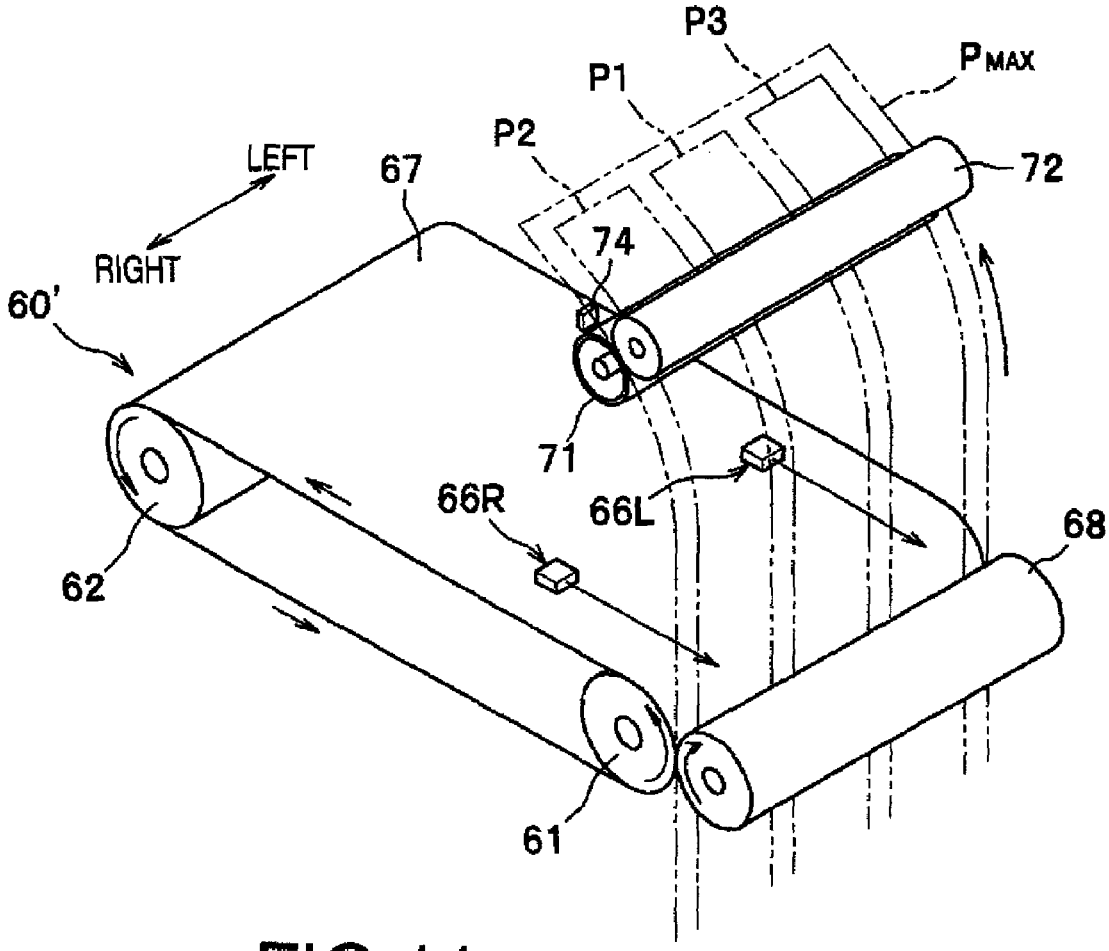
FIG. 11 is a sheet feeding behavior of the transfer unit having an intermediate transfer belt in the color printer according to a modified embodiment of the present invention.

The present invention may be applied to a color printer having the intermediate transfer belt or a photosensitive belt similarly effectively to determine one-sided alignment of the recording sheet P. An example of a transfer unit 60' (see FIG. 11) having a driving roller 61, a driven roller 62, an intermediate transfer belt 67, a secondary transfer roller 68, and two misalignment detectable sensors 66R, 66L will be described.

With the two misalignment detectable sensors 66R, 66L, one-sided alignment of the recording sheet P can be judged according to the method described above in the first embodiment. That is, the controller unit 110 determines that the recording sheet P is in the one-sided alignment when solely one of the two misalignment detectable sensors 66R, 66L detects presence of the recording sheet P (i.e., P2 or P3) being carried (i.e., judgment "ONE-SIDE" is made).

When the color printer 1 is provided with a single misalignment detectable sensor 66 (i.e., the right-side misalignment detectable sensor 66 R alone), one-sided alignment of the recording sheet P can be judged according to the method described above in the second embodiment. That is, the controller unit 110 determines that the recording sheet P is in the one-sided alignment when the sheet size information indicating the smaller width-size is entered and the misalignment detectable sensor 66R detects presence of the recording sheet P (i.e., P2) being carried (i.e., judgment "ONE-SIDE" is made).

The LED units 40 and the processing units 50, which form the test patterns TP on the conveyer belt 63 in the above embodiments, may be replaced with, for example, when the photosensitive belt in place of the conveyer belt 63 is employed, a light-emitter to emit light to form a latent image on the photosensitive belt and a developer to supply toner to the latent image so that the toner image is formed on the photosensitive belt.

In the above embodiments, the present invention is applied to the color printer 1, in which the recording sheet P is normally carried in the centered alignment so that the recording sheet P is carried to have its widthwise center be aligned to a widthwise center of the feeding path. However, the present invention can be similarly applied to a printer, in which a recording sheet is normally carried in the one-sided alignment and one side of the recording sheet is aligned to a widthwise end of the feeding path. Even in such a printer, the recording sheet may be carried in one-sided alignment, in which the recording sheet is aligned to the other widthwise end of the feeding path, and which is to be detected.

In the above embodiments, the present invention is applied to the color printer 1, in which the photosensitive drum is exposed to the illumination of the LEDs. However, the present invention may be applied to a printer in which the photosensitive drum is exposed to laser beams. Further, the present invention may be applied to, for example, a copier and an MFP (multifunction peripheral).

The recording sheet P illustrated in the above embodiments may be standard-sized paper, which includes a letter-sized sheet, a regular-sized postcard or envelope. Alternatively, the recording sheet P may be free-sized paper, which is arbitrarily cut by the user. Further the recording sheet P may not necessarily be paper, but may be, for example, an OHP film sheet.

What is claimed is:

1. An image forming apparatus, comprising:

a fixing unit to thermally fix an image transferred onto a sheet thereto;

an endless belt to carry the sheet in a feeding path toward the fixing unit;

a pattern forming unit to form an image pattern on the belt;

a sensor to detect presence of the sheet being carried by the belt; and a judging unit to judge as to whether the sheet is in one-sided alignment, in which the sheet is aligned to one of the widthwise sides in the feeding path based on a result detected by the sensor.

2. The image forming apparatus according to claim 1, wherein the sensor includes a first sensor, which is detectable of one of two widthwise-end portions of a maximum-allowable width-sized sheet, and a second sensor, which is detectable of the other of two widthwise-end portions of the maximum-allowable width-sized sheet, the maximum-allowable width-sized sheet having a largest allowable width to be processed in the image forming apparatus;

wherein the judging unit judges that the sheet being carried in the feeding path is in the one-sided alignment when solely one of the first and second sensors detects one of the widthwise-end portion of the maximum-allowable width-sized sheet.

3. The image forming apparatus according to claim 2, wherein the fixing unit is provided with a heater including two regions and a temperature sensor to detect temperature in one of the two regions in the heater closer to the first sensor; and wherein temperature in the heater is restricted from being increased when the judging unit judges that the sheet being carried is in the one-sided alignment based on the presence of the sheet detected by the first sensor.

4. The image forming apparatus according to claim 3, wherein the temperature in the heater is restricted from being increased when the judging unit judges that the sheet being carried is in the one-sided alignment based on presence of the sheet detected by the second sensor and when the temperature sensor detects the temperature in the one of the two regions in the heater closer to the first sensor being higher than a predetermined temperature.

5. The image forming apparatus according to claim 2, wherein the fixing unit is provided with a heater including two regions and a temperature sensor to detect temperature in one of the two regions in the heater closer to the first sensor; and wherein the image forming apparatus comprises an informer unit to alert a user of the image forming apparatus when the judging unit judges that the sheet being carried is in the one-sided alignment based on the presence of the sheet detected by the first sensor.

6. The image forming apparatus according to claim 5, wherein the informer unit alerts the user when the judging unit judges that the sheet being carried is in the one-sided alignment based on the presence of the sheet detected by the second sensor and when the temperature sensor detects the temperature in the one of the two regions in the heater closer to the first sensor being higher than a predetermined temperature.

7. The image forming apparatus according to claim 1, wherein the sensor includes at least a first sensor, which is detectable of one of two widthwise-end portions of a maximum-allowable width-sized sheet, the maximum-allowable width-sized sheet having a largest allowable width to be processed in the image forming apparatus; wherein the fixing unit is provided with a heater including two regions and a temperature sensor to detect temperature in one of the two regions in the heater closer to the one of the two widthwise-end portion of the maximum-allowable width-sized sheet; and wherein the judging unit judges that the sheet being carried is in the one-sided alignment when information indicating that a smaller width-sized sheet is to be carried in the feeding path is entered in the image forming apparatus and the first sensor detects presence of the sheet being carried.

8. The image forming apparatus according to claim 1, wherein the sensor is arranged in a position to oppose a surface of the belt with the feeding path in-between.

9. The image forming apparatus according to claim 1, wherein the sensor is switchable between a pattern-detectable mode, in which the sensor is detectable of the image pattern formed on the belt, and a carried-sheet detectable mode, in which the sensor is detectable of the sheet being carried in the feeding path.

10. The image forming apparatus according to claim 1, wherein the judging unit is capable of estimating a length of the sheet based on a length of time in which the sensor continues to detect the sheet being carried.

* * * * *